United States Patent [19]

Wells

[11] 4,280,129

[45] Jul. 21, 1981

[54] VARIABLE MUTUAL TRANSDUCTANCE TUNED ANTENNA

[76] Inventor: Donald H. Wells, 7127 Kipling, Holland, Ohio 43528

[21] Appl. No.: 73,695

[22] Filed: Sep. 10, 1979

Related U.S. Application Data

[63] Continuation-in-part of Ser. No. 831,880, Sep. 9, 1978, abandoned.

[51] Int. Cl.[3] ..... H01Q 1/32

[52] U.S. Cl. ..... 343/715; 343/750

[58] Field of Search ..... 343/749, 750, 713, 715, 343/900

[56] References Cited

U.S. PATENT DOCUMENTS

| | | | |
|---|---|---|---|
| 3,400,403 | 9/1968 | Spilsbury | 343/750 |
| 3,798,654 | 3/1974 | Martino et al. | 343/750 |
| 4,080,604 | 3/1978 | Wosniewski | 343/750 |
| 4,117,493 | 9/1978 | Altmayer | 343/750 |

*Primary Examiner*—Eli Lieberman

*Attorney, Agent, or Firm*—William Preston Hickey

[57] ABSTRACT

An electromagnetic tuning device for RF circuits and particularly loading coils for antennas is disclosed. The preferred devices have a coil which produces a generally torroidal shaped electromagnetic field that is intensified by either a core of ferromagnetic material or a second coil inside the other coil. An insulating material surrounds and hermetically seals the coil and field intensifying device that is inside said coil; and an electrically conductive tuning ring is positioned outside of the insulating material for producing a counter magnetic field which opposes and cuts down the field produced by the first mentioned coil. In one embodiment, the tuning ring is threaded and it threadably engages the insulating material so it can be adjustably positioned relative to the torroidal field. In another embodiment the tuning ring is connected in electrical series circuit with a variable resistor. In both embodiments the tuning ring is insulated from ground and the coil so that nonproductive current flow is prevented. In a further embodiment, an electrically conductive shield having magnetic field transmitting windows is positioned between the tuning ring and the coil to greatly reduce capacitive effects on the coil by the environment.

19 Claims, 6 Drawing Figures

VARIABLE MUTUAL TRANSDUCTANCE TUNED ANTENNA

The present application is a Continuation-in-part of my copending application Ser. No. 831,880 filed Sept. 9, 1978, now abandoned, and similarly entitled.

TECHNICAL FIELD

The present invention relates to tuning devices for electromagnetic oscillations; and more particularly for tuning devices for antennas and R.F. transmission lines.

BACKGROUND OF THE INVENTION

A problem exists, for example, with quarter wave length antennas that are installed on vehicles, by reason of the fact that the surrounding metal structure has a pronounced capacitive effect which can drastically change the antenna's frequency from that of its uninstalled condition. With quarter wave length antennas, a quarter wave of each oscillation must occur in the transmission line or structure to which the antenna is electrically connected. In addition, metal structures close to the antenna produce a capacitive effect on the antenna to change its tuned frequency. A need therefore exists for a simple way of tuning the antenna after it is installed. In some instances the surrounding structures may have an effect on the tuning device itself, and for such environments a need exists for a tuning device that is substantially unaffected by its environment.

An object of the present invention therefore is the provision of a new and improved variable inductance tuning device which does not have internal inductance tuning structure which must be moved from a point outside of its housing.

A further object of the present invention is the provision of a new and improved impedance tuning device of the above described type having a primary inductance coil and an external electrically isolated tuning loop in which a parasitic electromagnetic field is produced which opposes the field of the primary inductance coil with a minimum capacitive effect and minimum resistance losses.

Another object of the invention is the provision of a tuning device for an antenna having a single tuning loop which when adjusted both changes the inductance of a loading coil for the antenna so that it has the correct electrical length to oscillate efficiently at a new frequency, and simultaneously changes a series tuned circuit so that it is tuned to pass the new frequency efficiently.

A further object of the present invention is the provision of a new and improved device of the above described type wherein the environment has substantially no effect on the device's adjustment of its transmitted frequency.

Further objects and advantages of the invention will become apparent to those skilled in the art to which the invention relates from the following description of the preferred embodiments that are described with reference to the accompanying drawings.

DESCRIPTION OF THE PREFERRED EMBODIMENTS

Figure 1:
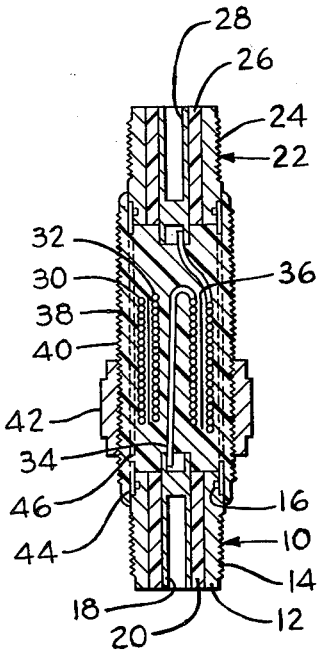
FIG. 1 is a cross sectional view of a tuning device embodying principles of the present invention.
Figure 2:
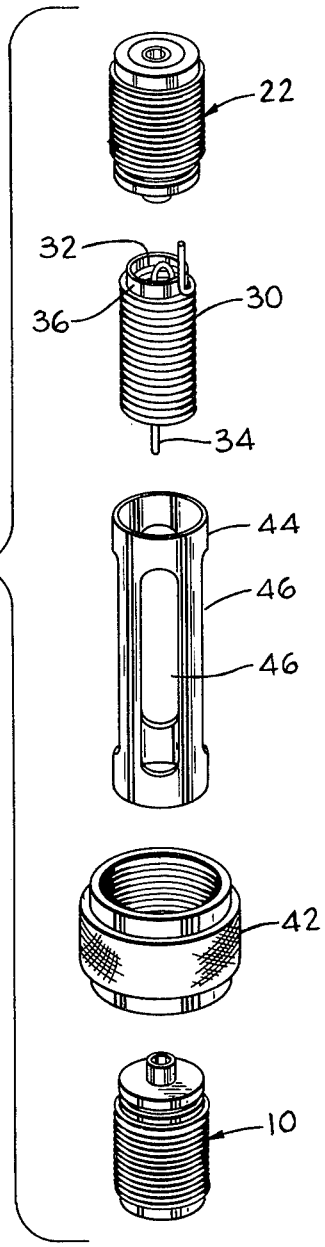
FIG. 2 is an exploded view of the device shown in FIG. 1.

The tuning device shown in FIGS. 1 and 2 is adapted to be used either at the base of a whip antenna (not shown) or in a R. F. transmission line. The device shown comprises a lower, support, connector 10, which in the present instance is a modified male half of a coaxial connector. The lower connector 10 comprises an outer grounding sleeve 12 having external threads 14 on its lower end and an annular recess 16 on its upper end. A tubular terminal pin 18 is supported centrally of the grounding sleeve 12 by means of an insulator sleeve 20 that is firmly supported by the sleeve 12. The lower connector 10 is spaced apart from an upper connector 22 that is identical therewith and includes a corresponding grounding sleeve 24, insulator sleeve 26, and terminal pin 28. A copper wire coil 30 is positioned axially between the terminals 18 and 28 with a wire leading from the top of the coil 30 to terminal 28 and connected thereto by solder. In order that the electromagnetic flux of coil 30 will be intensified without increasing its length, coil 30 is connected to another coil 32 which is positioned internally of the coil 30 and is connected in series circuit therewith. In the embodiment shown, a wire 34 is connected between the lower terminal 18 and the top of coil 32, and the bottom of coil 32 is connected directly to the bottom of coil 30. A tuning capacitive effect exists between the coils 30 and 32, and the amount of intercapitance is controlled by the thickness of a tubular spacer 36 that is positioned over the coil 32 and on which the coil 30 is wound. It will be seen that a concentrated electromagnetic field is provided by coils 30 and 32, which field extends as a torus from the top of the coil externally thereof and then around back through the center of the coils. A nonconductive plastic 38 is injection molded around the coils, between connectors 10 and 22 to rigidly connect the assembly, protect it from weather, and provide the external surface. Threads 40 are molded into the external surface for receiving an internally threaded, tubular electrically conductive tuning loop 42. In the embodiment shown the tuning loop 42 is a metallic sleeve and the threads 40 extend well below the lower end of the coil 30 so that it can be threaded into and out of the magnetic field created at one end of the coil. The flux intercepted by the loop 42 creates a flow of electricity around the loop which in turn produces a magnetic field opposing that of the coil 30. In this manner the inductance of the coil 30 can be reduced from a point outside of the coil without a moveable mechanical connection between the inside and outside of the device. The present invention thereby avoids this possibility of external fields being transmitted through such an adjustment mechanism.

According to further principles of the present invention a tubular electrically conductive shield 44 is positioned over the coils 30 and 32 to isolate them from R.F. fields in the environment. One end of the shield is rolled into the recess 16 to attach it firmly to the connector 10, and the other end of the shield is rolled into the corresponding recess of the connector 22 to firmly attach it thereto. The shield and connector 22 are thereby grounded by anything connected to the connector 10. The shield 44 has four windows 46 therein which are spaced around the shield and each of which runs longitudinally between positions sufficiently above and below the coil 30 that flux passes out one end of the windows and in the other end of the windows 46. By moving the tuning loop 42 upwardly over the windows a counter magnetic field is produced which opposes that of the coils to thereby reduce their inductance.

It will be seen that the coils 30 and 32 provide a capacitance therebetween that is in series with their inductance to provide a series tuned circuit that allows passage of D.C. electricity. As the tuning loop 42 is moved up into the field of the coils, the inductance is reduced, thereby reducing the electrical length of an antenna connected thereto, and increasing the frequency at which the antenna can efficiently oscillate. Simultaneously therewith the tuned frequency of the series tuned transmitting circuit formed by coils 30 and 32 is also shifted upwardly, so that the antenna maintains its Q value at the new higher frequency. It will now be seen that the double coil arrangement provides a capacitive effect to provide a series tuned circuit of high Q whose tuned frequency shifts in the same direction as does the tuned frequency of an antenna connected thereto.

Figure 3:
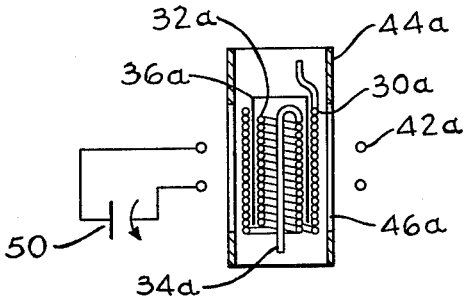
FIG. 3 is a schematic view of a device similar to that shown in FIGS. 1 and 2 but differing principally therefrom in that the tuning ring is a conductor which leads to a variable resistance device that is remotely located.

The embodiment shown in FIG. 3 corresponds generally to that of FIGS. 1 and 2 but differs principally in the construction of the tuning loop. Those portions of the embodiment shown in FIG. 3 which correspond to portions shown in FIGS. 1 and 2 are designated by a like reference numeral characterized further in that a suffix "a" is affixed thereto. In the embodiment shown in FIG. 3, the tuning loop **42*a* comprises at least one coil of an electrical conductor wire which extends to a remote location where a variable reactance mechanism 50** is installed in series therewith. By varying the reactance, and particularly resistance, the tuned frequency of the device can be changed remotely.

Figure 4:
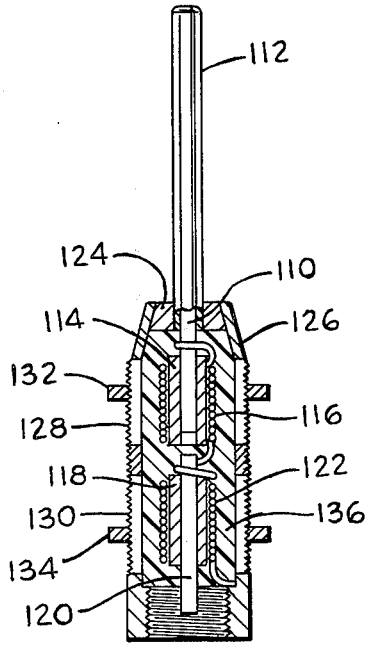
FIG. 4 is a longitudinal sectional view through another embodiment of the invention.

The embodiment shown in FIG. 4 is sufficiently significant that it will be completely and independently described. The antenna shown in FIG. 4 comprises an antenna rod 110 having a plastic coating 112 thereon. The plastic 110 is removed from the lower end thereof, and the bared end is received in a ceramic insulator tube 114 containing ferromagnetic particles so that it has a high permeability to magnetic flux. A copper wire coil 116 is wrapped around the insulator tube 114, and the top end of the coil is soldered to the antenna rod 110. Another insulator tube 118, that is identical to the insulator tube 114, is positioned axially of the antenna rod beneath the insulator tube 114. A terminal pin 120 of the diameter used in commercial coaxial cable connectors extends through the insulator tube 118 and projects a sufficient distance out of the bottom thereof to be received in a female cable connector, not shown. Another copper coil 122 is wrapped around the insulator tube 118, and the top end of the coil 122 is soldered to the pin 120 and to the bottom of the coil 116. A compression ferrule 124 is positioned over the plastic coating 112 upwardly of the bared end of the rod 110, and the inwardly tapered end of a tubular shield 126 wedges the ferrule 124 against the coating 112.

The bottom end of the shield 126 projects beneath the bottom end of the pin 120 a proper distance, and is internally threaded, to serve as a female coaxial cable connector. The sidewalls of the shield 126 are slotted longitudinally opposite the coils 116 and 122 to provide windows 128 and 130 respectively. The outside surface of the shield 126 is threaded to receive tuning nuts 132 and 134 adapted to be positioned longitudinally with respect to the coils 116 and 122 respectively. The bottom end of the coil 122 is soldered to the shield 126 and a hardened plastic 136 fills the inside of the shield from the ferrule 124 to the projecting end of the pin 120 to lock the parts together.

The antenna shown in FIG. 4 is intended to be installed on the end of a male coaxial cable connector to which a transmission line is connected. The signal passes from the pin 120 through the coil 116 to the metal rod 110 of the antenna. The signal passing through the coil 116 produces magnetic lines of flux one half of which passes through the annular insulator core 114 and the other half of which passes outwardly of the coil 116 with some of the external flux passing through the windows 128. By moving the tuning ring 132 longitudinally of the windows 128, differing amounts of flux can be intercepted by the tuning ring 132. The flux passing through the tuning ring 132 produces eddy currents around the ring 132 which opposes the lines of force from the coil 116 to thereby decrease the inductance of the coil from the value it would have if the tuning ring were not present. By adjusting the transmitter or receiver that is connected to the pin 120 to a fixed frequency and moving the ring upwardly or downwardly to a maximum signal, a precise antenna tuning is obtained.

It will further be seen that the present embodiment provides means for adjusting the impedance of the transmission line to match that of the antenna. The signal from the pin 120 passes through the coil 122 to the shield 126 which is grounded by the coaxial cable connected to the antenna. Any flow of current from the pin 120 to ground produces a field about the coil 122, the inner portion of which passes through the core 118 and the outer portion of which passes through the windows 130. By moving the tuning ring 134 longitudinally of the windows, an impedance match can be obtained with that of the transmission line. This can be easily sensed when maximum signal strength is obtained. It can now be seen that the shield 126 is grounded and is interpositioned between the electrostatic field of the coils 116 and 122, and the surrounding structures, so that a change in the capacitance of the surrounding structures will not change the set frequency of the tuned antenna.

Figure 5:
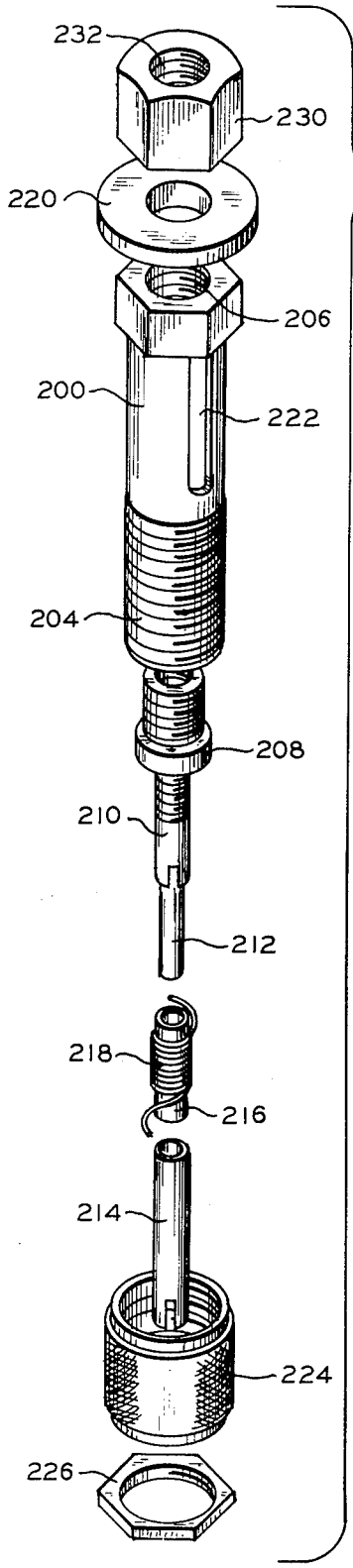
FIGS. 5 and 6 are an exploded view and an assembly, respectively, of another embodiment of the invention.
Figure 6:
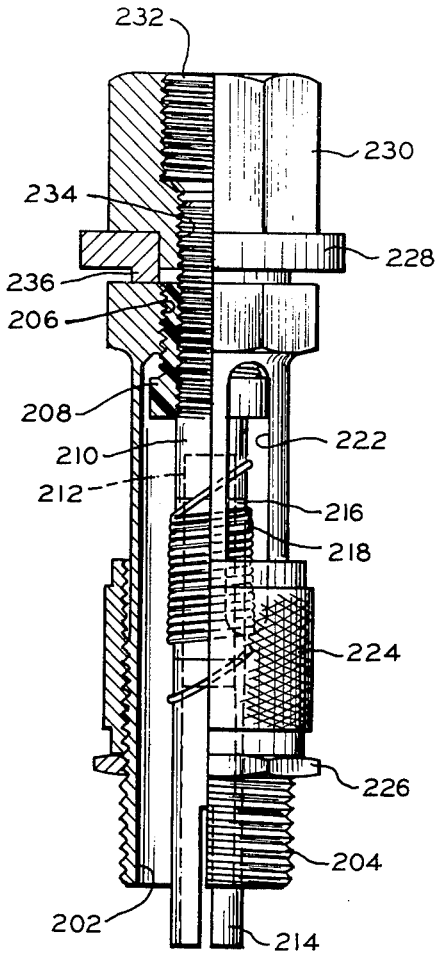

FIGS. 5 and 6 show a tuning assembly embodying the present invention and which is part of a coaxial connector for attaching a transmission line to the antenna. The embodiment comprises a generally elongated cup-shaped body 200 having a central chamber 202 which opens out of one end thereof. The cup-shaped body 200 has external threads 204 adjacent the open end of the body so that this end will receive the nut of a male portion of a coaxial connector. The closed end of the cupshaped body 200 is provided with a threaded reduced diameter opening 206 which receives a threaded insulator bushing 208 that in turn is threaded onto a center section of a terminal pin 210. The unthreaded end of the terminal pin 210 is bored out and slotted to receive one end of a short fiberglass insulating rod 212, the other end of which is received in a tubular terminal pin of the same size as the center terminal pin 214 of a female coaxial connector. The terminal pin 210 is crimped onto one end of the fiberglass rod and the tubular terminal pin 214 is staked to the other end of the fiberglass rod. The fiberglass rod 212 passes through a tubular ferromagnetic core 216 that in turn is surrounded by a coil 218, one end of which is soldered to terminal pin 210 and the other end of which is soldered to the tubular terminal pin 214. Parts 208 through 214 when assembled are installed centrally of the chamber 202 and a plastic is injected into the chamber to insulate and hermatically seal the coil and connecting portions of the terminal pins. Three windows 222 are milled into the walls of the tubular body 200 opposite the coil 218 and a threaded tuning sleeve 224 is threaded onto the external threads of the body 200 such that it can be positioned longitudinally of the windows 222 to tune the assembly after an antenna rod is affixed thereto and the antenna is installed on the structure where it is to be used. A jam nut 226 is threaded up against the tuning sleeve 224 to lock the sleeve in position.

In the embodiment shown, the threaded end of the terminal pin 210 projects out of the body 200 and through an insulator bushing 228 to be received in a cup-shaped adaptor nut 230. The adaptor nut 230 has a stepped bore extending therethrough to provide an upper chamber 232 that is threaded to receive the bottom end of a threaded antenna, not shown, and a reduced diameter bottom threaded opening 234 that is threaded to receive the upper threaded end of the terminal pin 210. The end of the pin 210 projects into the chamber 232 a slight distance to make contact with the central conducting portion of a fiberglass jacketed antenna threaded into the chamber 232. The insulator bushing 228 has a reduced diameter portion 236 on its lower face so that it will pass through and center the antenna in an opening of any sheet metal structure, as for example a fender of an automobile, on which the assembly is to be mounted. By threading the nut 230 down onto the terminal pin 210, the sheet metal is clamped between the insulator bushing 228 and the end of the tubular body 200 in a manner wherein the tubular body 200 is automatically grounded to the structure on which the assembly is to be mounted. The insulator bushing 228 and adaptor nut 230 may not be required in all instances, since other means may be provided for connecting an antenna to the pin 210 and for mounting the assembly onto a support structure.

It will now be seen that applicant has provided a tuning device for antennas and the like which utilizes a predominantly inductive load for tuning an antenna at a low frequency and decreases the inductive load for higher frequencies to provide a system having minimum $I_2R$ losses and maximum radiating efficiencies. This is accomplished by variations in the strength of an induced electromagnetic field which opposes that of a completely sealed tuned circuit from a point outside of the sealed unit. In addition the device can be shielded and the tuning accomplished from a point outside of the shielding. In a preferred arrangement the primary inductance producing device is a coil within a coil so that a minimum of heat loss occurs by reason of the electromagnetic field.

While the invention has been described in considerable detail, I do not wish to be limited to the particular embodiments shown and described, and it is my intention to cover hereby all novel adaptations, modifications and arrangements thereof which come within the practice of those skilled in the art to which the invention relates and which fall within the purview of the following claims.

I claim:

1. A tuning device comprising: a generally tubular metallic body having a central chamber therein and with a magnetic flux escaping window in the sidewalls thereof, electromagnetic flux producing means in said central chamber, said means having first and second electrical terminals which communicate externally of said body, an inductance tuning loop externally of said tubular body and crossing over said window, said loop producing a counter electromagnetic flux which opposes the flux escaping from said window, and means for varying said counter electromagnetic flux produced by said loop.

2. The tuning device of claim 1 wherein said inductance tuning loop is an annular ring in which a flow of electricity is produced by said escaping flux, and wherein the function of said last mentioned means is accomplished by changing the position of said ring relative to said window.

3. The tuning device of claim 1 wherein said inductance tuning loop is a loop in which a flow of electricity is produced by said escaping flux, and wherein the function of said last mentioned means is accomplished by varying the resistance to the flow of electricity in said loop.

4. The tuning device of claim 1 wherein said electromagnetic flux producing means is a coil having flux amplifying means located internally thereof.

5. A tuning device comprising: a generally tubular metallic body having a central chamber therein and with a magnetic flux escaping window in the sidewalls thereof, first and second terminals in respective ends of said body, an electromagnetic flux producing coil in said central chamber, said coil being electrically connected between said first and second terminals, means inside said coil for intensifying the electromagnetic flux of said coil, and an inductance tuning loop positioned externally of said body adjacent said window in a position to produce a counter electromagnetic flux opposing that escaping through said window from said coil.

6. The tuning device of claim 5 wherein said means inside said coil is a second coil operatively connected to said first and second terminals to add its flux to that of said first mentioned coil.

7. A tuning assembly comprising: a generally tubular metallic body having a central chamber opening into one end thereof and with a magnetic flux escaping window in the sidewalls thereof, a first terminal pin in said chamber adjacent said one end thereof, a second terminal pin adjacent the other end of said chamber, a coil in said chamber with respective ends of said coil being electrically connected to respective terminal pins, means inside said coil for intensifying the field produced by said coil and part of which passes through said window, and an electrically conductive ring around said body and positionable longitudinally of said window.

8. The tuning assembly of claim 7 wherein said second terminal pin has a threaded end for receiving the threaded end of an antenna rod.

9. The tuning assembly of claim 8 wherein said threaded end of said second terminal pin projects out of said tubular body.

10. The tuning assembly of claim 7 wherein said means is a ferromagnetic core.

11. The tuning assembly of claim 7 wherein molded plastic covers said tubular body to seal said chamber and its coil and means for intensifying the magnetic field of said coil.

12. The device of claim 11 wherein the outside of said molded plastic is threaded and the threads of the molded plastic is threadably engaged by internal threads on said electrically conductive ring.

13. A tuning device for an antenna comprising: a coil, an electrically conductive metallic member in the external field of said coil for producing a flow of electricity in said member which opposes said external magnetic field, said member being positionable longitudinally of said external magnetic field to change its resistance to said magnetic field, and a metallic shield between said electrically conductive member and said coil, said shield having windows opposite said coil and said member whereby positioning said electrically conductive member axially of said coil changes its impedance.

14. An antenna comprising: an exposed length of conductor for generating or receiving radio waves, a ferromagnetic axially extending core, a coil of electrically conductive material over said core, one end of said coil being connected to a transmission line terminal and the other end being connected to said exposed length of conductor, a tubular metallic shield surrounding said coil, said shield having field escaping windows therein, and a ring of electrically conductive material opposite said windows, said ring being adjustable axially of said coil, and whereby the inductance of said coil can be varied by changing the position of said ring.

15. The tuning assembly of claim 7 wherein molded plastic hermetically seals said coil and means inside said coil for intensifying the field produced by said coil.

16. A variable mutual transductance tuning device, and the like, comprising: a helically wound coil which produces a magnetic field of generally torroidal shape when electricity flows therethrough, first means inside said coil for intensifying said magnetic field, a tubular metallic shield surrounding said coil, said shield having field escaping windows therein, a generally cylindrical body of electrical insulating body encasing said coil, first means and tubular shield and providing a exterior surface of said insulating material, an electrically conductive tuning ring supported by said insulating body in a manner electrically isolated from ground and said coil to produce an electrical flow around said ring in response to a change in said magnetic field coming through said window, and means for varying either the electrical flow around said ring or the magnetic coupling of said ring with the magnetic field coming through said window.

17. The variable mutual transductance tuned circuit of claim 16 wherein said body has external threads thereon, and said last mentioned means comprising threads on said tuning ring which engage said external threads of said cylindrical body.

18. The variable mutual tranductance tuning device of claim 16 including means comprising a variable resistance for varying electrical flow through said tuning ring.

19. The variable mutual transductance tuning device of claim 11 wherein said first means is a core of paramagnetic material.

* * * * *